US005879466A

United States Patent [19]

Creger et al.

[11] Patent Number: 5,879,466

[45] **Date of Patent: *Mar. 9, 1999**

[54] APPARATUS AND METHOD FOR CLEANING RADIATOR FINS

[75] Inventors: Todd D. Creger, Metamora; William O. Jankovsky, Peoria, both of Ill.

[73] Assignee: Caterpillar Inc., Peoria, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 748,762

[22] Filed: Nov. 14, 1996

[51] Int. Cl.[6] ..... B08B 3/02

[52] U.S. Cl. ..... 134/18; 134/34; 134/57 R; 134/58 R; 134/169 A; 134/171; 134/198; 165/95; 180/68.4; 180/68.6

[58] Field of Search ..... 134/2, 18, 34, 134/22.18, 56 R, 58 R, 57 R, 104.1, 105, 123, 166 R, 169 A, 171, 198; 165/41, 51, 95; 180/53.8, 68.4, 68.6

[56] References Cited

U.S. PATENT DOCUMENTS

| | | | |
|---|---|---|---|
| 3,769,947 | 11/1973 | Crain | 123/14.01 |
| 4,332,292 | 6/1982 | Garberick | 165/95 |
| 4,494,384 | 1/1985 | Lott | 180/68.2 |
| 4,579,090 | 4/1986 | Konrath et al. | 165/41 |
| 4,653,574 | 3/1987 | Quinlisk et al. | 165/54 |
| 4,660,627 | 4/1987 | Deck | 165/86 |
| 4,666,531 | 5/1987 | Minard | 134/26 |
| 4,771,822 | 9/1988 | Barbosa | 165/41 |
| 5,186,240 | 2/1993 | Kennon et al. | 165/95 |
| 5,279,357 | 1/1994 | Kennon et al. | 165/95 |

FOREIGN PATENT DOCUMENTS 1524580 9/1987 United Kingdom .

OTHER PUBLICATIONS

Perry et al., "Chemical Engineer's Handbook"—McGraw–Hill (1973) pp. 5–16 and 5–32 to 5–38.

*Primary Examiner*—Jan Ludlow
*Attorney, Agent, or Firm*—Steve D. Lundquist

[57] ABSTRACT

An apparatus and method for periodically cleaning the fins of a radiator of an internal combustion engine using a nozzle system with at least one nozzle directed toward the fins, and a cleaning agent delivery system connected to the nozzle system. The apparatus determines the presence of airflow resistance through the fins, generates an airflow resistance signal, delivers the airflow resistance signal to a control system, and delivers a control signal to the cleaning agent delivery system.

16 Claims, 3 Drawing Sheets

APPARATUS AND METHOD FOR CLEANING RADIATOR FINS

TECHNICAL FIELD

This invention relates generally to an apparatus and method for cleaning the fins of a radiator and more particularly to an apparatus and method for spraying a cleaning agent through the fins of a radiator.

BACKGROUND ART

A water cooled internal combustion engine requires a radiator to remove heat from the coolant. The heat is removed by air passing through the fins of the radiator. If the fins become clogged with dirt and debris, the cooling efficiency of the radiator is reduced and the engine might overheat.

Construction and earthmoving machines operating in harsh environments frequently require cleaning of the radiator fins to remove dirt that accumulates. These machines also operate under heavy load conditions, thus increasing the heat generated by the engine. Downtime and repairs due to heat-related problems are costly.

As another example, semi-tractor trucks may be driven hundreds of miles per day on highways. As they travel at highway speeds, debris accumulates in the fins of the radiators, which reduces the engine cooling capability. A semi-tractor truck is usually hauling a heavy load, which causes the engine to work harder and generate more heat. Once again, downtime and repairs due to heat-related problems are costly.

Several attempts in the prior art have been made to overcome the problem of keeping the fins of a radiator clean. For example, in U.S. Pat. No. 4,332,292, Garberick discloses a system for spraying a cleaning agent against the coils of a heat exchanger to remove dirt and debris. The spray interval can be automated with a timer to eliminate operator involvement. However, there is no indication that the heat exchanger coils require cleaning when the sprayer is activated, and there is no indication that the coils are adequately cleaned when the spray cycle is complete.

The present invention is directed to overcoming one or more of the problems as set forth above.

DISCLOSURE OF THE INVENTION

In one aspect of the present invention an apparatus for cleaning the fins of a radiator is provided. The radiator has a front surface and a back surface and is positioned so that the normal direction of airflow through the fins enters the front surface and exits the back surface. The apparatus includes a sensor system to determine airflow resistance, a nozzle system with at least one nozzle positioned to direct a cleaning agent toward the fins, and a cleaning agent delivery system connected to the nozzle system.

In another aspect of the present invention a method for cleaning the fins of a radiator is provided. The method includes the steps of determining the airflow resistance through the fins, generating an airflow resistance signal, delivering the airflow resistance signal to a control system, and delivering a control signal to a cleaning agent delivery system.

BEST MODE FOR CARRYING OUT THE INVENTION

Figure 1:
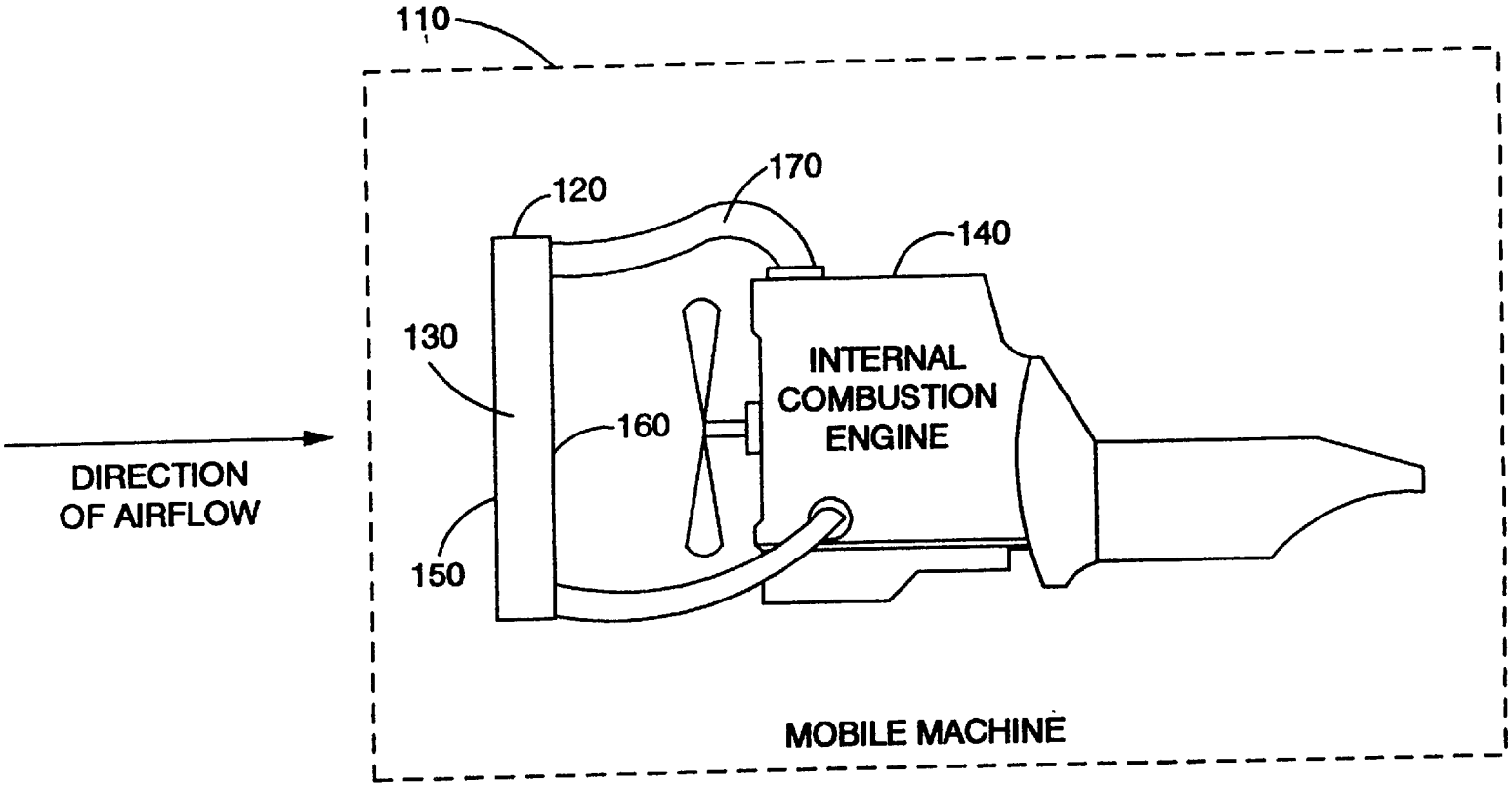
FIG. 1 is a block diagram illustrating an engine and radiator as associated with the present invention.

With reference to the drawings, and in particular to FIG. 1, an apparatus and method for periodically cleaning the fins 130 of a radiator 120 of an internal combustion engine 140 is disclosed. The internal combustion engine 140 may be used to provide power to a mobile machine 110, such as a construction machine, an earthmoving machine, or a semi-tractor truck.

Although the example of a radiator and an internal combustion engine in a mobile machine is used in the description of the present invention, it is to be understood that the present invention may apply to other configurations as well. For example, the radiator 120 and the internal combustion engine 140 may be used in a fixed location, such as for electric power generation. As another example, the radiator 120 may be part of a heat exchanger unit for heating and cooling a building.

The radiator 120 has a front surface 150 which normally faces toward the front of the mobile machine 110, and a back surface 160 which normally faces toward the rear of the mobile machine 110. The radiator 120 is located in the mobile machine 110 such that the normal direction of airflow through the fins 130 enters the front surface 150 and exits the back surface 160.

The radiator 120 contains a coolant 170 which circulates throughout the internal combustion engine 140. As the coolant 170 passes through the radiator 120, air traveling through the fins 130 removes heat from the coolant 170, which helps cool the internal combustion engine 140.

Figure 2:
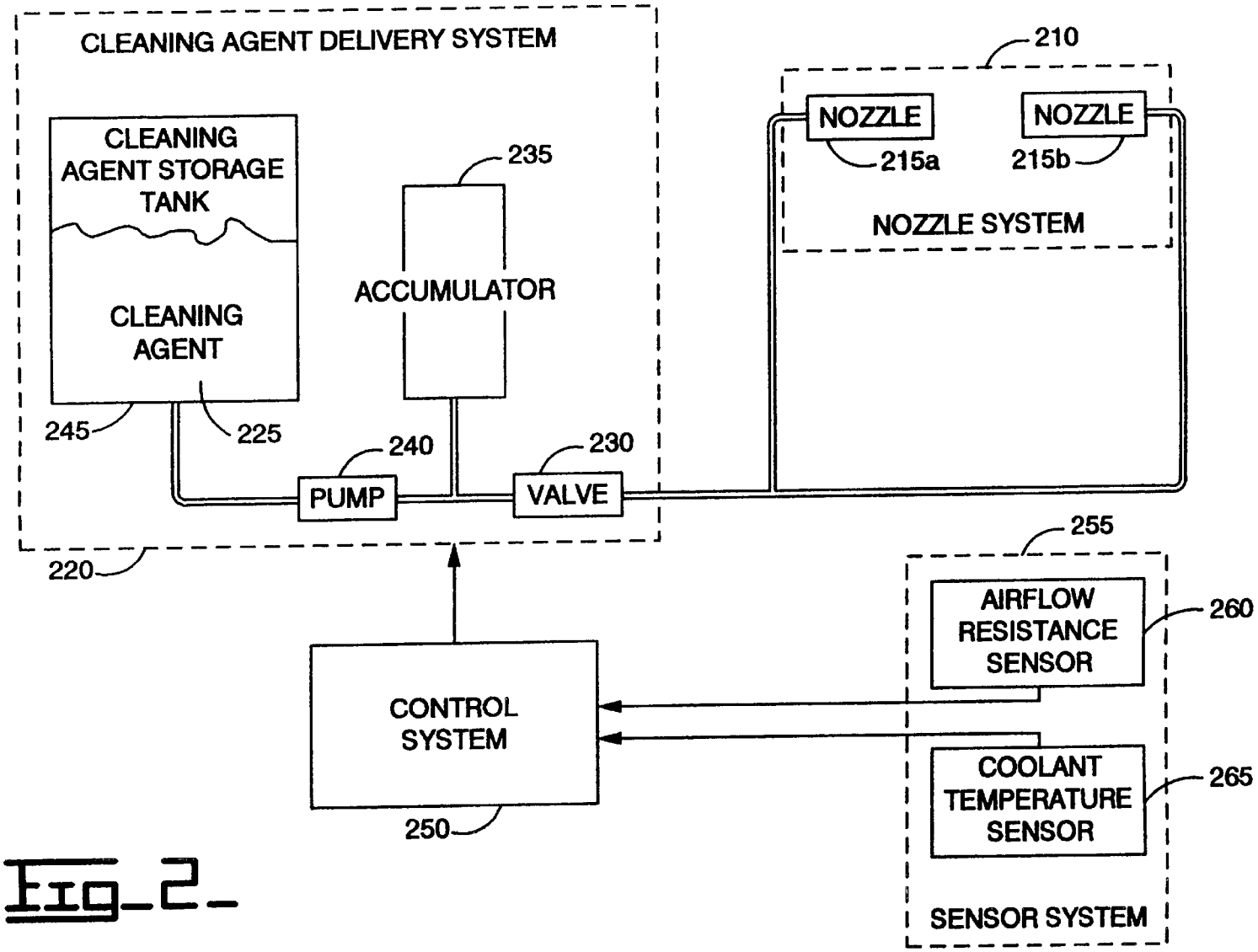
FIG. 2 is a block diagram illustrating an embodiment of the present invention.

Referring to FIG. 2, a sensor system 255 monitors the airflow through the fins 130 and determines if airflow resistance increases beyond a predetermined allowable value. The sensor system 255 includes at least one sensor, and may determine airflow resistance either directly or indirectly.

For example, the sensor system 255 may determine airflow resistance by the use of at least one airflow resistance sensor 260 located in a position relative to the radiator 120 so that the amount of airflow through the fins 130 is measured directly. Airflow resistance sensors are well known in the art. As an example, mass airflow sensors are used to determine the amount of air flowing through the air intake systems of fuel injected engines.

In one embodiment of the present invention, one airflow sensor 260 is located in a position relative to the radiator 120 to monitor the amount of airflow through the radiator 120.

In another embodiment of the present invention, a plurality of airflow resistance sensors 260 are located in positions relative to the radiator 120 so that each airflow resistance sensor 260 is positioned to monitor the amount of airflow through a respective portion of the radiator 120.

In still another embodiment of the present invention, at least one airflow resistance sensor 260 is positioned relative to the front surface 150 of said radiator 120 and at least one airflow resistance sensor 260 is positioned relative to the back surface 160 of said radiator 120. The value of the airflow determined at the front surface 150 is compared to the value of the airflow determined at the back surface 160 and a differential airflow resistance value is determined. The differential airflow resistance value indicates the increase in airflow resistance as air passes through the fins 130 of the radiator 120 and is proportional to the amount of blockage in the fins 130.

Another possible sensor in the sensor system 255 is a coolant temperature sensor 265. The coolant temperature sensor 265 is located in the mobile machine 110 so that it measures the temperature of the coolant 170. If the coolant temperature increases above a predetermined value, the sensor system 255 indirectly determines that airflow resistance may have increased, since increasing airflow resistance has a direct correlation to increasing temperature of the coolant 170.

Other types of sensors and combinations of sensors may be included in the sensor system 255 in the present invention. As examples, the speed of a fan used to move air through the fins 130 can be measured, the blockage of the fins 130 can be monitored with optical sensors, and so forth.

The sensor system 255 generates a signal which is delivered to a control system 250. In the preferred embodiment, the control system 250 is microprocessor based. However, a non-microprocessor based control system may be used. For example, the control system 250 may be comprised of relays or discrete electronic components.

The control system 250 may also receive information indicating the speed of the mobile machine 110 as it travels. This information can be used to compensate for airflow based on the speed of the mobile machine 110 when determining airflow resistance through the radiator 120.

The control system 250 delivers a control signal to a cleaning agent delivery system 220 which is configured to deliver a cleaning agent 225 to the fins 130. In the preferred embodiment, the cleaning agent delivery system 220 includes at least one valve 230 which is connected to a nozzle system 210, an accumulator 235 connected to the valve 230, a pump 240 connected to the accumulator 235, and a cleaning agent storage tank 245 connected to the pump 240.

In this preferred embodiment, the pump 240 delivers cleaning agent 225 to the accumulator 235 when the valve 230 is closed. The accumulator 235 stores pressurized cleaning agent 225 until it is needed for delivery to the nozzle system 210. The accumulator 235 may contain a pressurized gas which exerts pressure on fluid that is pumped into the accumulator 235. Alternatively, the accumulator 235 may exert pressure on the fluid by using weights, spring pressure, and the like.

It can be appreciated by those skilled in the art that alternatives to the preferred embodiment of the cleaning agent delivery system 220 may be used. For example, in the preferred embodiment, the pump 240 delivers pressurized cleaning agent 225 into the accumulator 235. As an alternative, a larger size pump may be used to deliver pressurized cleaning agent 225 to the nozzle system 210 directly, thus eliminating the need for the accumulator 235. Other systems for delivering the cleaning agent 225 may be used without deviating from the invention.

The nozzle system 210 includes at least one nozzle 215*a*,215*b* positioned and oriented to direct the cleaning agent 225 toward the fins 130. Each nozzle 215*a*,215*b* is configured to deliver a pressurized spray of cleaning agent 225 through the fins 130 to dislodge and remove dirt and debris that has accumulated on and between the fins 130.

In one embodiment, at least one nozzle 215*a* is positioned in front of the radiator 120 to deliver cleaning agent 225 through the fins 130 in the normal direction of airflow.

In a second embodiment, at least one nozzle 215*b* is positioned in back of the radiator 120 to deliver cleaning agent 225 through the fins 130 in the direction opposite to the normal direction of airflow.

In a third embodiment, at least one nozzle 215*a* is positioned in front of the radiator 120 and at least one nozzle 215*b* is positioned in back of the radiator 120.

The choice of nozzle placement may be determined by the type of dirt and debris to be cleaned from the fins 130. For example, dust and light dirt may be removed more readily by spraying cleaning agent 225 through the fins 130 from at least one nozzle 215*a* positioned in front of the radiator 120. Larger particles, such as insects and gravel, may be removed more easily by spraying cleaning agent 225 through the fins 130 from at least one nozzle 215*b*positioned in back of the radiator 120.

In one embodiment of the present invention, a plurality of valves 230 are used to deliver cleaning agent 225 to selected nozzles 215*a*,215*b* based on the portions of the radiator 120 where air resistance is sensed. For example, the nozzles 215*a* located in front of the radiator 120 may be connected to a valve 230 and the nozzles 215*b* located in back of the radiator 120 may be connected to a different valve 230. Each valve 230 is separately controlled by the control system 250.

As another example, in the embodiment in which portions of the radiator 120 are monitored by respective ones of a plurality of airflow resistance sensors 260, a plurality of valves 230 may be used to control the delivery of cleaning agent 225 to the desired portion of the radiator 120 that is determined to contain blockage.

Figure 3:
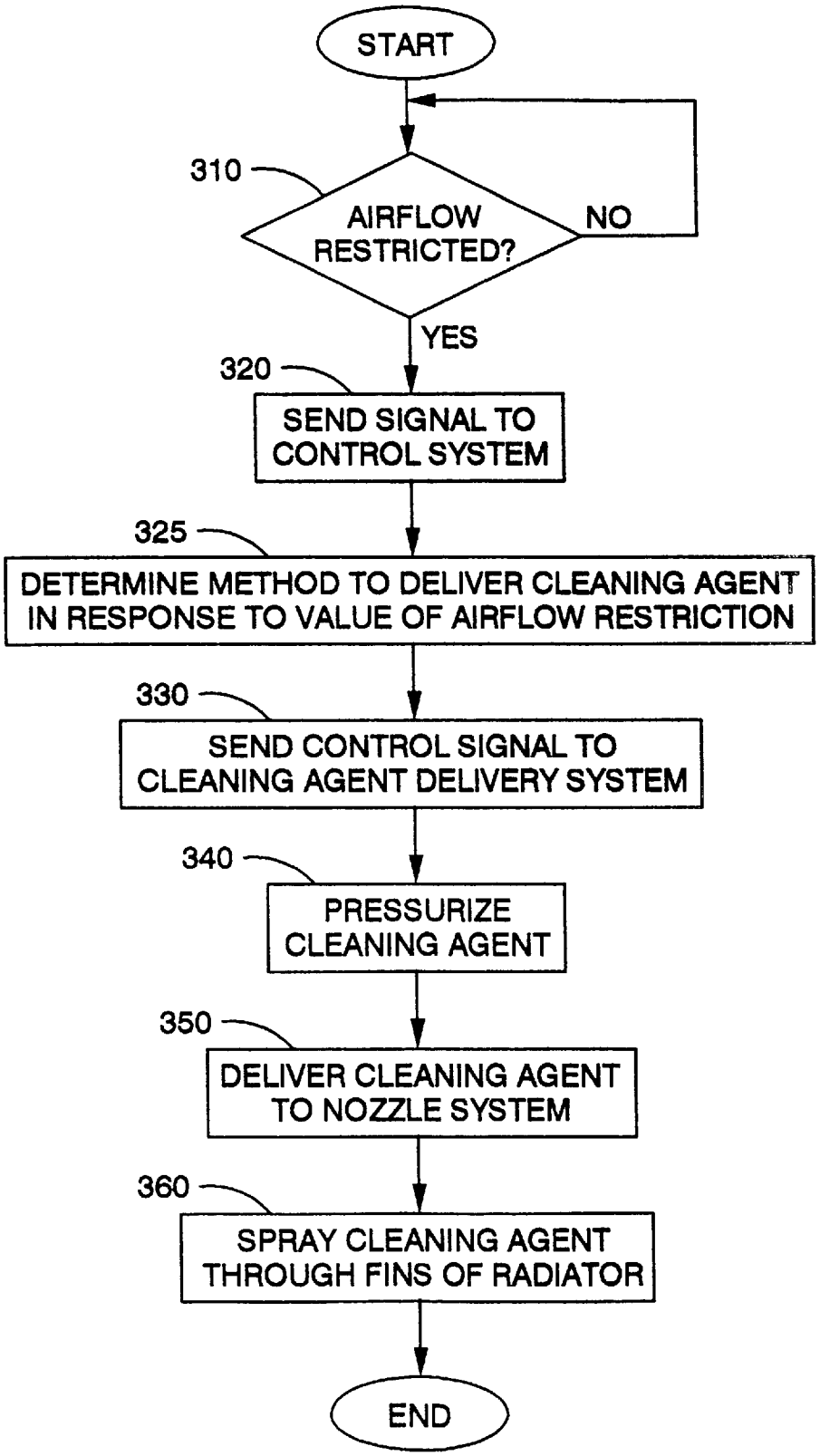
FIG. 3 is a flow diagram illustrating the method of FIG. 2.

Referring to FIG. 3, in a decision block 310 the sensor system 255 determines if the airflow resistance through the fins 130 has increased beyond a predetermined threshold. An airflow resistance signal indicating excessive airflow resistance is delivered to the control system 250 in a first control block 320.

In a second control block 325 the control system 250 determines the method to use to deliver the cleaning agent 225 based on the determined amount and type of airflow resistance. For example, the pressure generated by the cleaning agent delivery system 220 may vary in response to the value of airflow resistance.

As another example, the cleaning agent 225 may be delivered to select nozzles 215*a*,215*b* for delivery to a respective side or portion of the radiator 120.

As still another example, the control system 250 may cause the cleaning agent 225 to be delivered in bursts instead of a steady stream for more effective cleaning under certain conditions. A controlled combination of bursts and a steady stream may also be used to deliver cleaning agent 225 to the radiator 120.

In a third control block 330 the control system 250 sends a control signal to the cleaning agent delivery system 220 in response to the airflow resistance signal.

In a fourth control block 340 the cleaning agent delivery system 220 pressurizes the cleaning agent 225. The pressurized cleaning agent 225 is delivered to the nozzle system 210 in a fifth control block 350. The nozzle system 210 then sprays the pressurized cleaning agent 225 through the fins 130 of the radiator 120 in a sixth control block 360.

In one embodiment of the invention, the cleaning agent 225 is sprayed through the fins 130 until the sensor system 255 determines that the airflow resistance has been reduced to below a predetermined value. When this value is reached, the control system 250 then delivers a control signal to stop spraying the cleaning agent 225.

As an alternative embodiment, the cleaning agent 225 is sprayed for a predetermined time. Other methods of determining the amount or duration of cleaning agent 225 to be sprayed may be used without deviating from the idea of the invention.

INDUSTRIAL APPLICABILITY

As one example of an application of the present invention, earthmoving machines often are required to operate in extremely dusty and dirty environments. Dirt frequently clogs the openings between the fins of radiators. As the movement of air is restricted by the accumulation of dirt on and between the fins, the efficiency of the cooling system decreases dramatically.

The earthmoving machines are usually operating under heavy loads. The combination of inefficient engine cooling and heavy working conditions can cause the engines to overheat, leading to costly engine failures and downtime.

The costs of maintaining and repairing these machines, as well as the costs of the downtime that results from maintenance and repair are financially burdensome to owners of these machines. The owners also cannot rely on machine operators to periodically check and clean the radiators to keep the fins free of airflow restrictions.

The present invention will monitor the airflow through the fins and clean them out as needed without unnecessary down time.

Other aspects, objects, and features of the present invention can be obtained from a study of the drawings, the disclosure, and the appended claims.

We claim:

1. An apparatus for periodically cleaning the fins of a radiator of an internal combustion engine in a mobile machine, said radiator having a front surface and a back surface and being positioned in said mobile machine such that the normal direction of airflow through the fins enters the front surface and exits the back surface, and said radiator containing a coolant which circulates throughout said internal combustion engine, comprising:

a nozzle system including at least one nozzle positioned and oriented to direct a cleaning agent toward said fins;

a cleaning agent delivery system connected to said nozzle system;

a control system electrically connected to said mobile machine, said control system being adapted to deliver a control signal to said cleaning agent delivery system to deliver said cleaning agent to said fins in response to a condition of airflow resistance; and a sensor system electrically connected to said control system, said sensor system being adapted to determine said condition of airflow resistance, said controller being further adapted to vary at least one of the pressure and the location of delivery of said cleaning agent as a function of the determined airflow resistance.

2. An apparatus, as set forth in claim 1, wherein said cleaning agent delivery system includes:

at least one valve connected to said nozzle system;

an accumulator connected to said at least one valve;

a pump connected to said accumulator; and a cleaning agent storage tank connected to said pump.

3. An apparatus, as set forth in claim 2, wherein said accumulator is adapted for receiving and storing pressurized cleaning agent from said pump for delivery to said nozzle system.

4. An apparatus, as set forth in claim 1, wherein said sensor system includes at least one airflow resistance sensor located in a position relative to said radiator such that the amount of airflow through said fins is sensed and a resultant airflow resistance signal is delivered to said control system.

5. An apparatus, as set forth in claim 4, wherein said at least one airflow resistance sensor includes a plurality of airflow resistance sensors located in positions relative to said radiator such that the amount of airflow through respective portions of said fins is sensed and a resultant airflow resistance signal responsive to the amount of airflow through the respective portions of said fins is delivered to said control system.

6. An apparatus, as set forth in claim 4, wherein said at least one airflow resistance sensor includes at least one airflow resistance sensor located in front of said radiator and at least one airflow resistance sensor located in back of said radiator, said airflow resistance sensors being adapted to determine a difference in airflow between the airflow in front of said radiator and the airflow in back of said radiator.

7. An apparatus, as set forth in claim 1, wherein said sensor system includes a coolant temperature sensor located on said mobile machine, said coolant temperature sensor being adapted to determine the temperature of said coolant and deliver a responsive coolant temperature signal to said control system.

8. An apparatus, as set forth in claim 1, wherein said nozzle system includes at least one nozzle positioned in front of said radiator and oriented to direct said cleaning agent through said fins in the normal direction of airflow.

9. An apparatus, as set forth in claim 1, wherein said nozzle system includes at least one nozzle positioned in back of said radiator and oriented to direct said cleaning agent through said fins in the direction opposite to the normal direction of airflow.

10. An apparatus, as set forth in claim 1, wherein said nozzle system includes at least one nozzle positioned in front of said radiator and at least one nozzle positioned in back of said radiator.

11. An apparatus, as set forth in claim 2, wherein said at least one valve includes a plurality of valves connected to a plurality of nozzles, each of said plurality of valves being adapted to deliver said cleaning agent to a respective at least one nozzle.

12. A method for periodically cleaning the fins of a radiator of an internal combustion engine in a mobile machine, said radiator having a front surface and a back surface and being positioned in said mobile machine such that the normal direction of airflow through the fins enters the front surface and exits the back surface, and said radiator containing a coolant which circulates throughout said internal combustion engine, including the steps of:

determining a condition of airflow resistance through said fins;

generating an airflow resistance signal in response to determining the condition of airflow resistance;

delivering said airflow resistance signal to a control system electrically connected to said mobile machine;

delivering a control signal to a cleaning agent delivery system in response to a value of said airflow resistance signal; and delivering a cleaning agent through a nozzle system to said fins in response to said control signal, at least one of the pressure and the location of delivery of said cleaning agent being varied by said controller as a function of the determined airflow resistance.

13. A method, as set forth in claim 12, further including the steps of:

pressurizing said cleaning agent;

delivering said pressurized cleaning agent to at least one nozzle connected to said nozzle system; and spraying said cleaning agent through said fins.

14. A method, as set forth in claim 13, including the step of varying the pressure of said cleaning agent delivered to said at least one nozzle in response to the value of said airflow resistance signal.

15. A method, as set forth in claim 13, including the step of delivering said pressurized cleaning agent to said at least one nozzle in at least one of a continuous stream and a series of bursts.

16. An apparatus for periodically cleaning the fins of a radiator of an internal combustion engine in a mobile machine, said radiator having a front surface and a back surface and being positioned in said mobile machine such that the normal direction of airflow through the fins enters the front surface and exits the back surface, and said radiator containing a coolant which circulates throughout said internal combustion engine, comprising:

means for determining a condition of airflow resistance through said fins;

means for generating an airflow resistance signal in response to determining the condition of airflow resistance;

means for delivering said airflow resistance signal to a control system electrically connected to said mobile machine;

means for delivering a control signal to a cleaning agent delivery system in response to a value of said airflow resistance signal; and means for delivering a cleaning agent through a nozzle system to said fins in response to said control signal, at least one of the pressure and the location of delivery of said cleaning agent being varied by said controller as a function of the determined airflow resistance.

* * * * *